US011932997B2

(12) United States Patent
Simões Vicente

(10) Patent No.: US 11,932,997 B2
(45) Date of Patent: Mar. 19, 2024

(54) MODULAR PAVEMENT SYSTEM WITH RESILIENT CUSHIONING SYSTEM

(71) Applicant: ISSG SPORTS INNOVATIONS, LDA, Feijó (PT)

(72) Inventor: Nuno Miguel Simões Vicente, Feijó (PT)

(73) Assignee: ISSG SPORTS INNOVATIONS, LDA, Feito (PT)

( * ) Notice: Subject to any disclaimer, the term of this patent is extended or adjusted under 35 U.S.C. 154(b) by 616 days.

(21) Appl. No.: 17/188,355

(22) Filed: Mar. 1, 2021

(65) Prior Publication Data

US 2021/0180269 A1 Jun. 17, 2021

Related U.S. Application Data

(63) Continuation of application No. PCT/IB2019/057320, filed on Aug. 30, 2019.

(30) Foreign Application Priority Data

Aug. 31, 2018 (PT) ..... 111115

(51) Int. Cl.

| | |
|---|---|
| ***E01C 13/04*** | (2006.01) |
| ***E04F 15/10*** | (2006.01) |
| ***E04F 15/22*** | (2006.01) |

(52) U.S. Cl.

CPC ..... *E01C 13/04* (2013.01); *E01C 13/045* (2013.01); *E04F 15/10* (2013.01); *E04F 15/225* (2013.01); *E01C 2201/10* (2013.01); *E04F 2290/044* (2013.01)

(58) Field of Classification Search

CPC .... E01C 13/04; E01C 13/045; E01C 2201/10; E04F 15/10; E04F 15/225; E04F 2290/044

USPC ..... 404/34–46

See application file for complete search history.

(56) References Cited

U.S. PATENT DOCUMENTS

| | | | | |
|---|---|---|---|---|
| 8,099,915 | B2 * | 1/2012 | Moller, Jr. | E01C 11/24 52/177 |
| 2009/0165414 | A1 * | 7/2009 | Burk | E04F 15/225 52/403.1 |
| 2009/0235605 | A1 * | 9/2009 | Haney | E04F 15/10 52/741.1 |
| 2017/0101788 | A1 * | 4/2017 | Hassan | E04F 15/02183 |
| 2017/0101789 | A1 * | 4/2017 | Cormier | E04F 15/22 |

* cited by examiner

*Primary Examiner* — Raymond W Addie

(57) ABSTRACT

This invention refers generically to pavement modules, more specifically to a pavement module that includes a resilient cushioning system to cushion the impacts caused by users in the interconnected modules that form the covering of a pavement. The system consists of a pavement module with an upper side and a resilient cushioning system that integrates a cushioning spike.

12 Claims, 5 Drawing Sheets

MODULAR PAVEMENT SYSTEM WITH RESILIENT CUSHIONING SYSTEM

SCOPE OF THE INVENTION

This invention refers generically to pavement modules, more specifically to a pavement module that includes a resilient cushioning system to cushion the impacts caused by users in the interconnected modules that form the covering of a pavement.

BACKGROUND OF THE INVENTION

Modular systems to cover pavements have long been known, and there is tremendous diversity of documents mentioning them, whether they are coverings in natural materials, such as wood or cork, or made of synthetic or artificial materials.

Mostly, this type of pavement is used to form a floor surface for sports and other activities in indoor and outdoor enclosures, and usually has as its primary function the covering of the pavement of the enclosure, usually made of cement. Additionally, by taking advantage of the possibility of the modules having different colors, this type of flooring can also be used to delimit different areas of the terrain, or to highlight an object that is placed on top of it.

Although the physical characteristics of the modules and the method of interconnection between the modules allow for some flexibility, the typical systems of interconnected modules are rigid and adverse. Short- and long-term use of modular floors for sports activities can cause discomfort and injury to users. These conventional module systems absorb little or no impact associated with walking, running or jumping. As a consequence, some users may experience pain or discomfort and joint injuries when using interconnected module systems. The need therefore arises for the modular systems for pavement covering to include features that provide a more comfortable surface.

Thus, solutions have arisen that, coupled with the pavement modules, help to solve or reduce the problem mentioned above.

An example of such a solution is the one mentioned in document US2015225965 that presents a "Pavement module with a resilient supporting member".

Or the one mentioned in document US2018195294 that presents a "Shock-absorption equipment in pavement modules".

Advantages of the Invention

Compared to the solutions presented in the aforementioned documents, the this invention's equipment has the advantage that, when a force is exerted on the upper surface of the pavement module, the cushioning of the force exerted on the pavement module is progressive, there are several ways of absorbing the impact, with the impact being absorbed by displacement of the components in existing gaps and by deformation of the materials, instead of only by deformation of the materials as in the solutions presented in the aforementioned documents.

These characteristics allow not only a greater efficiency in the absorption of impact and in the corresponding energy restitution, but also a greater durability of the equipment itself, both of the modules and of the shock absorbers, because they do not need to be deformed nor do they need to have more or less violent impacts between them.

In addition, the cushioning spike, by integrating a sealing ring that, by fitting into the sealing ring groove on the inside of the wall of the first rigid support element, not only ensures better attachment to the pavement module, but also makes it even more difficult for the air to escape from the recess, making it more difficult for the air to escape from the air pocket, creating a pressurized air pocket.

BRIEF DESCRIPTION OF DRAWINGS

These and other characteristics can be easily understood by means of the attached drawings, which are to be considered as mere examples and in no way restrictive of the scope of the invention. In the drawings, and for illustrative purposes, the measurements of some of the elements may be exaggerated and not drawn to scale. The absolute and relative dimensions do not correspond to the real ratios for the embodiments of the invention.

In a preferred embodiment.

Figure 1:
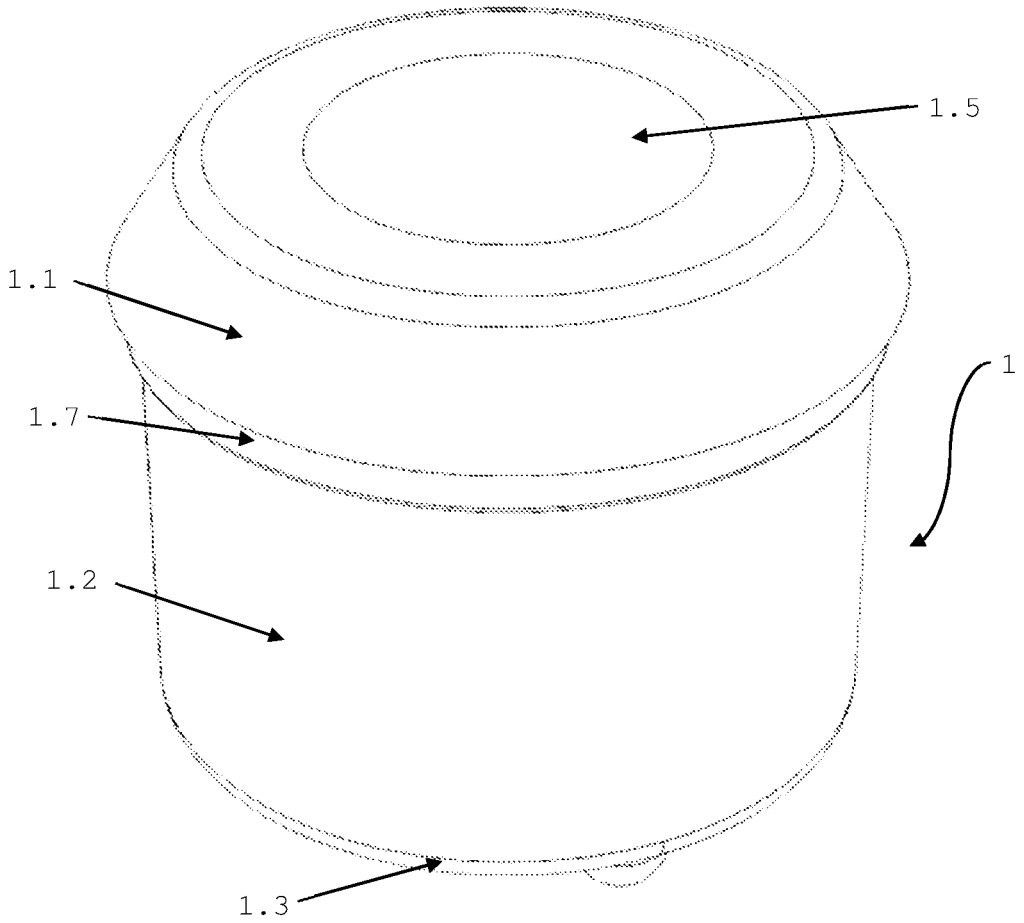
FIG. 1 shows a top view of the cushioning spike of the invention's equipment.
Figure 2:
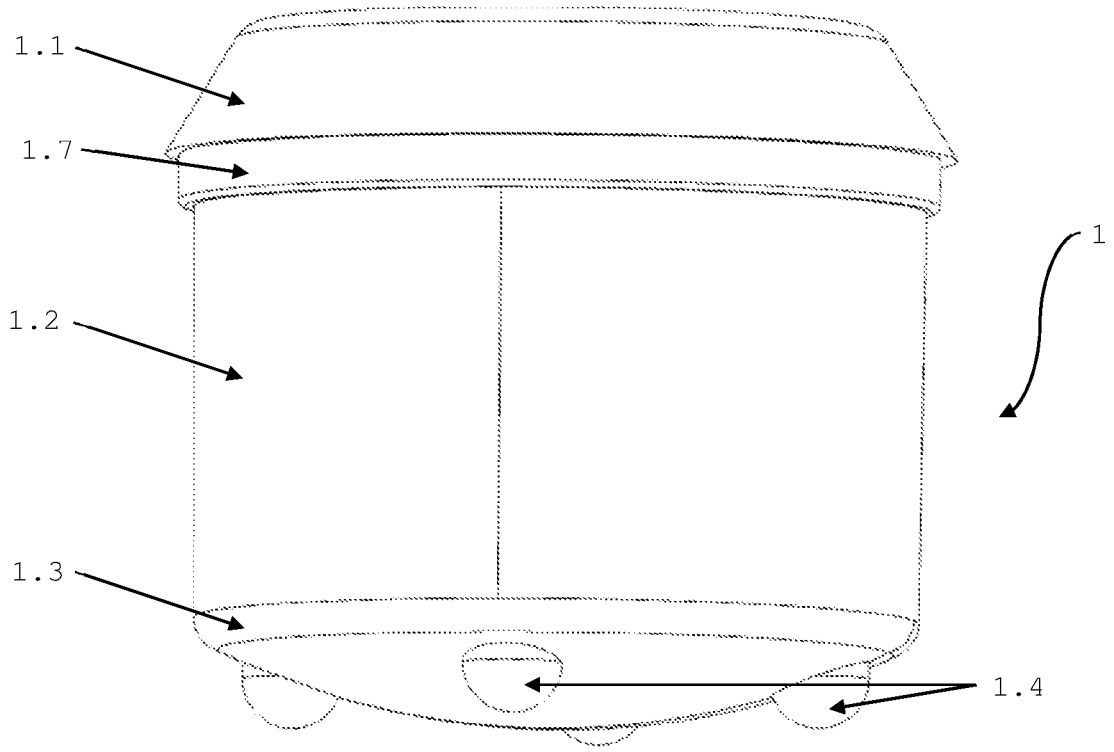
FIG. 2 shows a bottom view of the cushioning spike of the invention's equipment.
Figure 3:
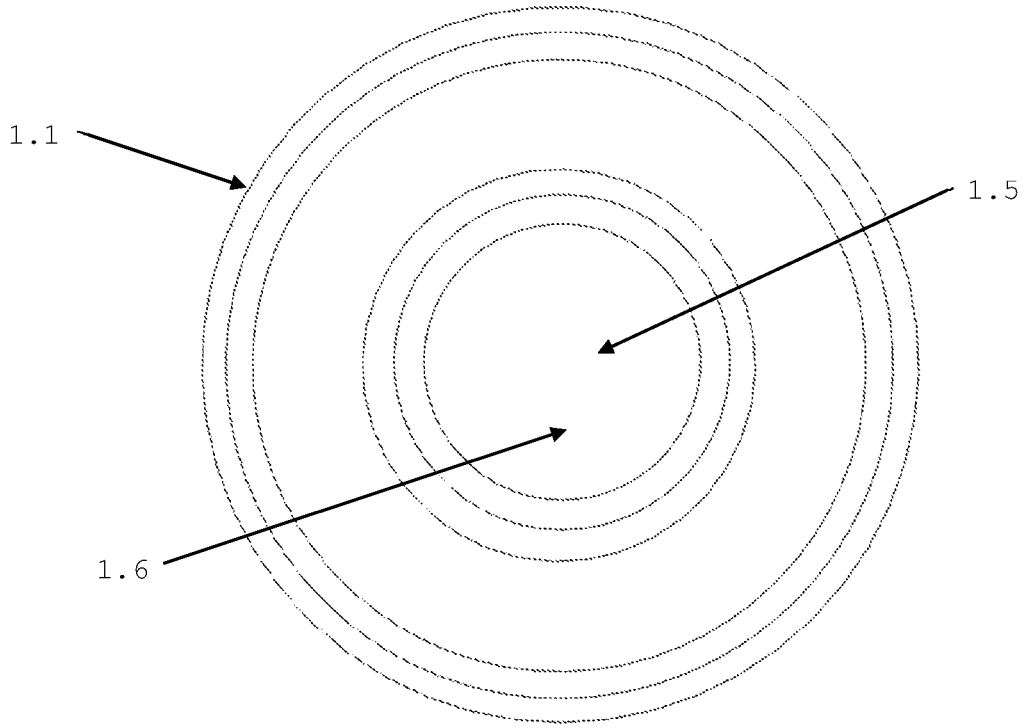
FIG. 3 enables observing a top view of the cushioning spike of the invention's equipment.
Figure 4:
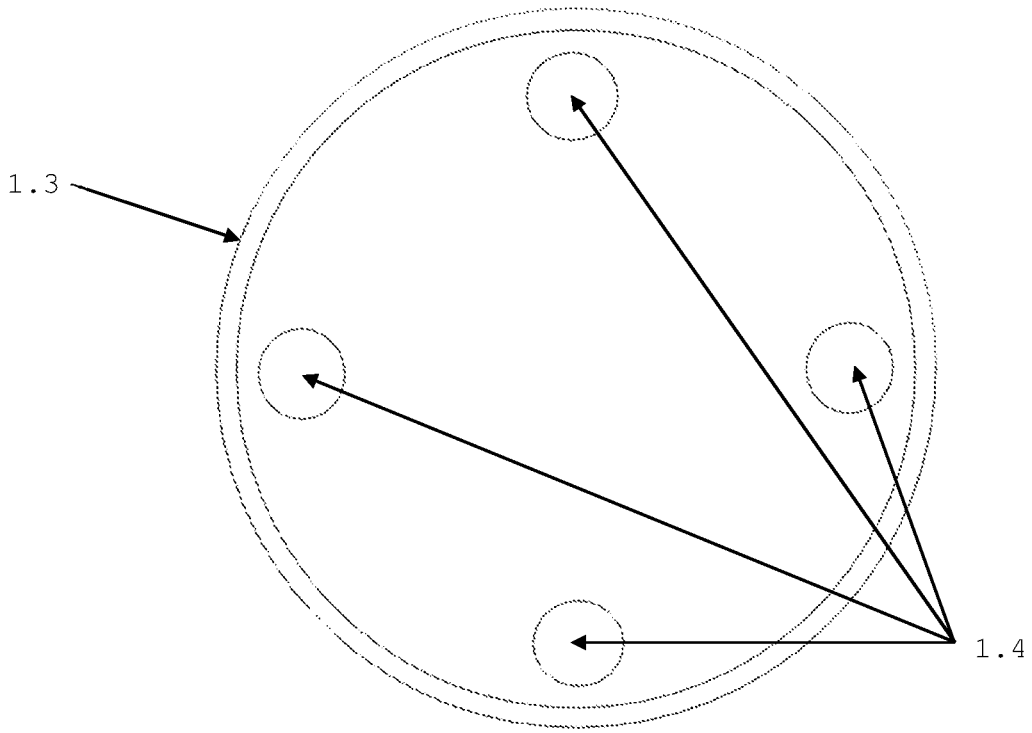
FIG. 4 shows a bottom view of the cushioning spike of the invention's equipment.
Figure 5:
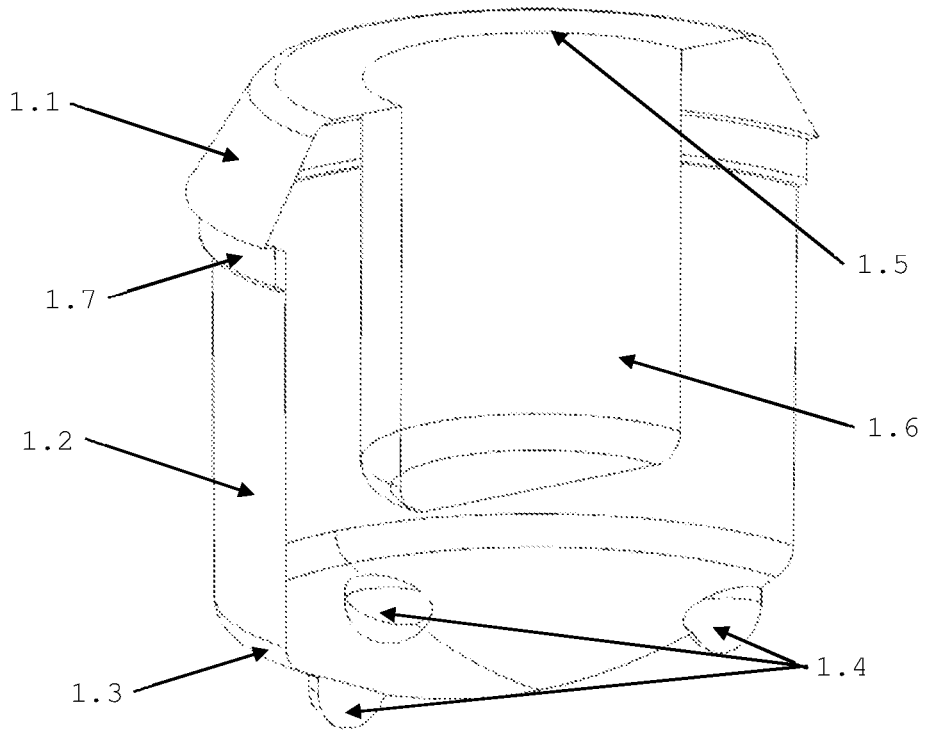
FIG. 5 presents a cross sectional view of the cushioning spike of the invention's equipment.
Figure 6:
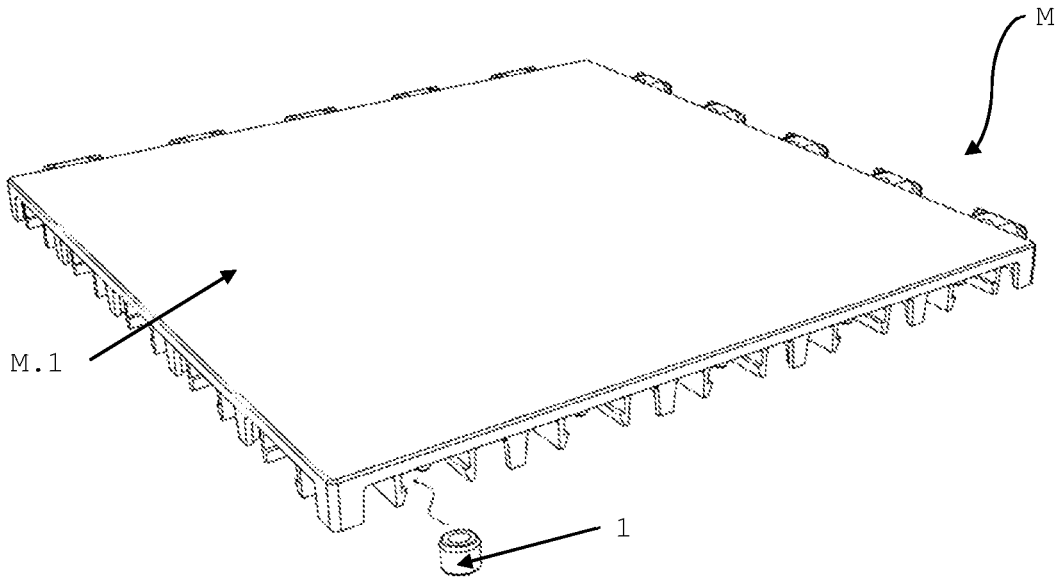
FIG. 6 presents a top view of the pavement module with the cushioning spike to be inserted into the recess.
Figure 7:
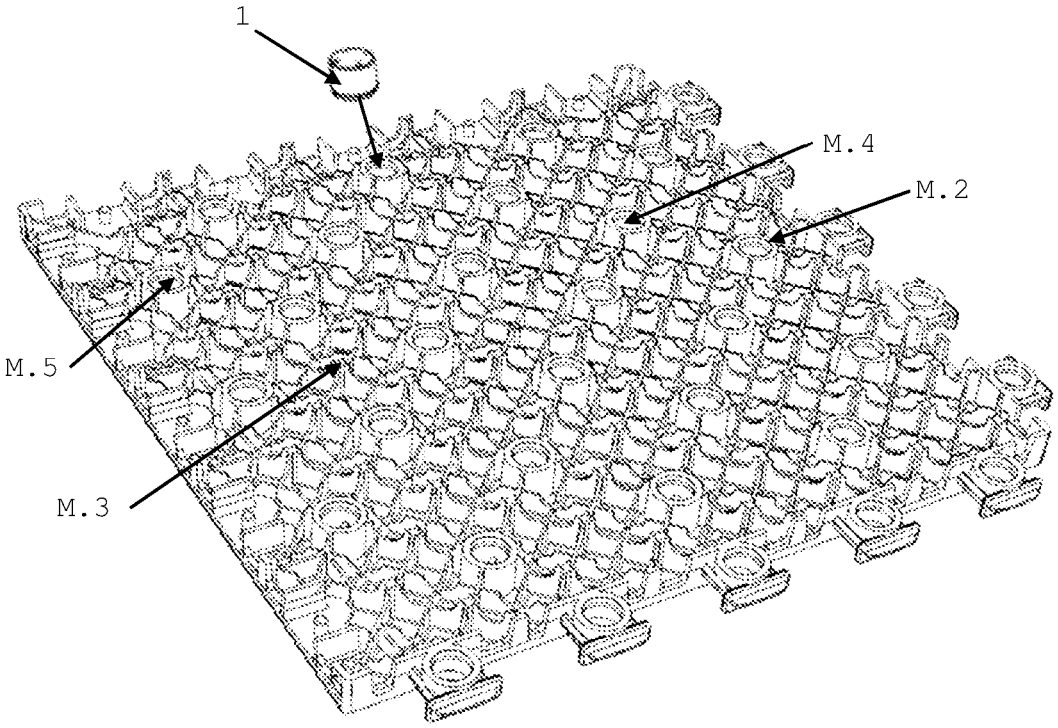
FIG. 7 shows a bottom view of the pavement module with the cushioning spike to be inserted into the recess.
Figure 8:
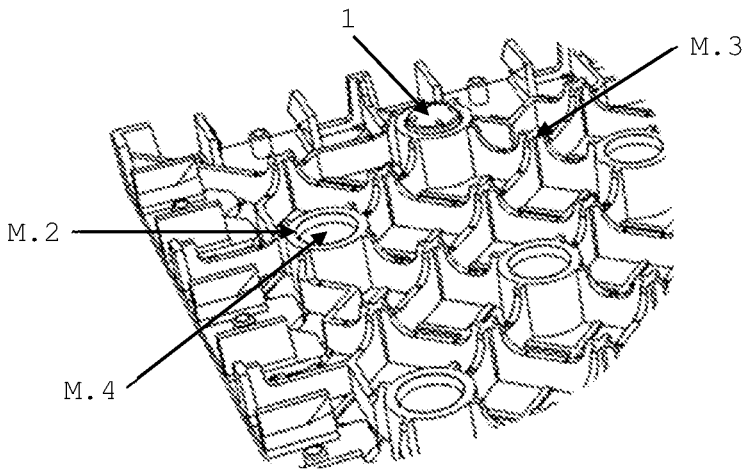
FIG. 8 shows a detail of a bottom view of the pavement module with the cushioning spike properly inserted in the recess.
Figure 9:
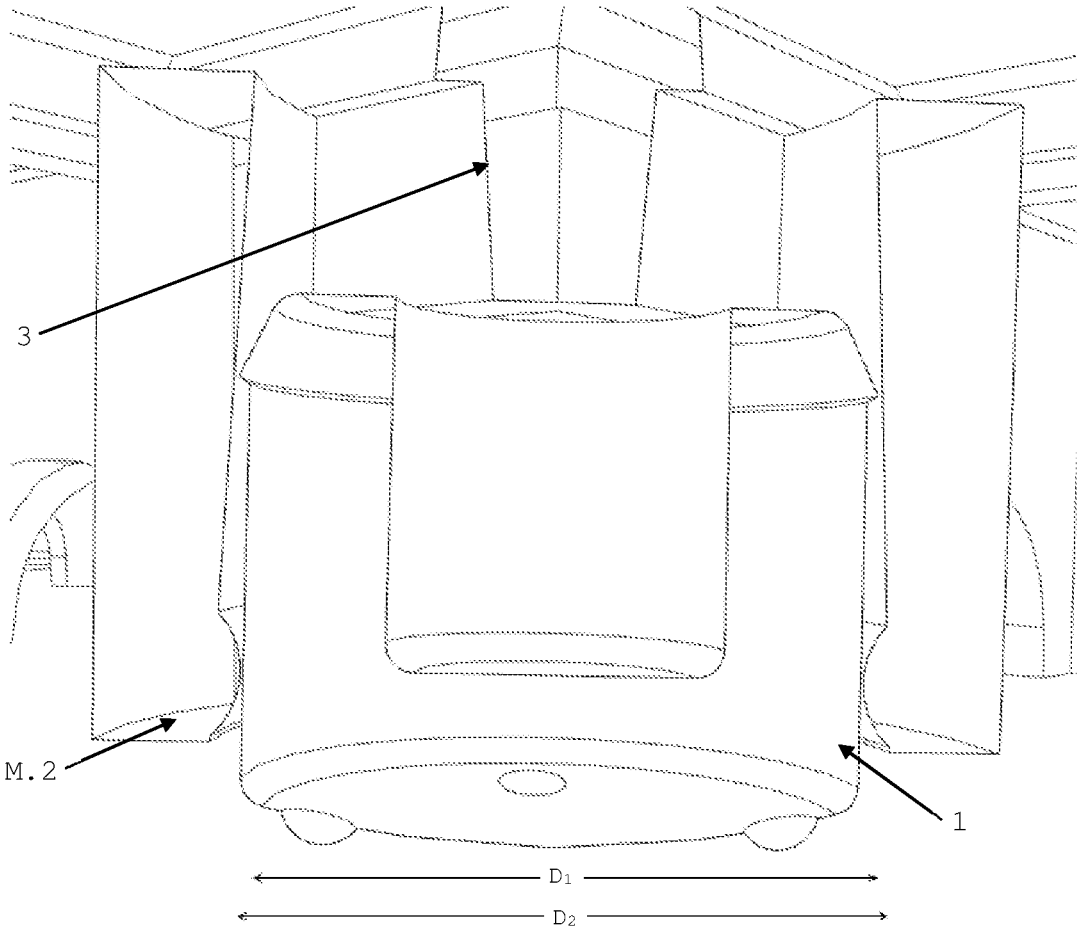
FIG. 9 shows a cross sectional view of the pavement module with the cushioning spike properly inserted in the first rigid support element, showing the maximum inner diameter $D_1$ of the first rigid support element, as well as the maximum outer diameter $D_2$ of the cushioning spike. The body and base gaps are also shown, as well as the air pocket.

Marked in the figures are the elements and components of this invention's equipment, as well as elements necessary for its operation:

1—Cushioning spike
1.1—Head of the spike
1.2—Body of the spike
1.3—Base of the spike
1.4—Feet of the spike
1.5—Orifice of the spike
1.6—Cavity of the spike
1.7—Sealing ring of the spike
3—Air pocket
M—Pavement module
M.1—Top surface layer
M.2—First rigid support element
M.3—Second rigid support element
M.4—Recess
M.5—Sealing ring groove

DETAILED DESCRIPTION OF THE INVENTION

The term "modular" refers to objects of regular or standardized units or dimensions that provide multiple components for the assembly of flexible arrangements and uses.

"Resilient" means an object capable of returning to its original shape or position after being compressed.

"Rigid" means stiff or with a lack of flexibility. However, a "rigid" support system can flex or compact slightly under load, although to a lesser degree than a "resilient" support system.

The "upper surface" of a pavement module means the surface that is exposed when the pavement module is placed on a support.

"Impact absorption" means the ability to smooth or dampen shock forces and dissipate kinetic energy.

"Energy restitution" means the ability to return to the user part of the energy expended by the user when impacting with the pavement module, through the elasticity of the materials and the proper fit between the components.

"Laying base" means the surface on which the cushioning spike rests. In this invention, the "laying base" can be considered the pavement.

The following shapes: "substantially spherical", "substantially semi-spherical", "substantially cylindrical", "substantially circular", "truncated cone", are understood as preferential shapes for the invention to be made, and it may work with other formats.

A "substantially centered" position is understood as a preferential position for the embodiment of the invention, which may work with other positions.

As mentioned above, typical modular pavements are rigid and adverse and provide little or no shock absorption. The principles described here present methods and equipment that provide better shock absorption, more flexibility and more efficient energy restitution than previous systems.

The application of the principles described herein is not limited to the specific embodiment presented.

The principles described herein can be used with any covering system.

Additionally, although some of the embodiments presented incorporate multiple new characteristics, the characteristics can be independent and do not all need to be used together in a single embodiment.

Pavement systems in accordance with the principles described herein may comprise any number of the presented characteristics.

With reference to the figures, the invention refers to a resilient cushioning equipment intended to be used in pavement modules, especially in interconnected modules that form the covering of a pavement.

One aspect of this invention refers to a system of pavement modules that includes a pavement module and a plurality of shock absorbers connected to the pavement module.

The pavement module may have a construction in which the top surface is open, a solution usually used in pavements used in outdoor enclosures, or a construction in which the upper surface is closed, a solution usually used in indoor enclosures.

The shock absorbers are typically mounted on the bottom surface of the pavement module.

The shock absorber consists of a cushioning spike (1) incorporating the body of the spike (1.2) which has a truncated-cone shape, with a first extremity that is attached to the second end of the sealing ring of the spike (1.7), which has a truncated-cone shape, and a second extremity which is attached to the base of the spike (1.3), where the cylindrical radius at the first extremity is equal to or slightly larger than the cylindrical radius at the second extremity. The first extremity of the sealing ring of the spike (1.7) is attached to the second extremity of the head of the spike (1.1). The head of the spike (1.1) has a truncated-cone shape, where the cylindrical radius at the first extremity is equal to or less than the cylindrical radius at the second extremity, with a second extremity that is attached to the first end of the sealing ring of the spike (1.7) and a first closed extremity that has a orifice of the spike in a substantially centered position (1.5). The base of the spike (1.3), which is attached to the second extremity of the body of the spike (1.2), has a substantially spherical shape with the concavity facing the body of the spike (1.2). Next to the outer edge of the base of the spike (1.3) are at least three feet of the spike (1.4) that are substantially semi-spherical in shape. The orifice of the spike (1.5) extends into the body of the spike (1.2) forming a cavity of the spike (1.6).

The pavement module (M) comprises an upper surface enclosed by a top surface layer (M.1), a plurality of first rigid support elements (M.2) that integrate in their inner wall a sealing ring groove (M.5), a plurality of second rigid support elements (M.3) and a plurality of recesses (M.4).

The cushioning spike (1) is sized to fit inside the first rigid support element (M.2), i.e., in the recess (M.4). Therefore, the maximum inner diameter $D_1$ of the first rigid support element (M.2) must be equal to or slightly smaller than the maximum outer diameter $D_2$ of the cushioning spike (1).

The shock absorbers individually mounted on the pavement module (M) do not have to occupy all recesses (M.4), so the number of shock absorbers mounted on the pavement module (M) can vary from 1 to the number of recesses (M.4) in the pavement module (M).

In a first embodiment, the cushioning spike (1) is inserted under pressure into the recess (M.4) thus ensuring that at least a circumference of the outer side of the wall of the body of the spike (1.2) is in permanent contact with the inner side of the wall of the first rigid support element (M.2), thus preventing, when a force is exerted on the upper surface of the pavement module (M), the body of the spike (1.2) from deforming. The sealing ring of the spike (1.7) fits into a corresponding groove with an inverted shape on the inside of the wall of the first rigid support element (M.2), and in the sealing ring groove (M.5), preventing the cushioning spike (1) from moving from its correct position, especially when installing the floors. The connecting line from the first end of the sealing ring of the spike (1.7) to the second end of the head of skype (1.1) is in permanent contact with the inner wall of the first rigid support element (M.2).

The base of the spike (1.3) and the feet of the spike (1.4) are outside the recess (M.4), so there is no contact of the pavement module (M) with the pavement. When the pavement module (M) is at rest, i.e. when no force is being applied to the top surface layer (M.1), it is the base of the spike (1.3) that is in contact with the laying base.

When a force is exerted on the top surface layer (M.1), since it is an element of the cushioning spike (1) that is in contact with the seating base, the force is transmitted from the pavement module (M) to the cushioning spike (1).

With the body of the spike (1.2) inserted under pressure within the recess (M.4) and therefore unable to be deformed due to the force exerted on the pavement module (M), in a first moment, i.e., when contact with the pavement module (M) is made, and since the air in the air pocket (3) formed by the cavity of the spike (1.6) the space delimited by the head of the spike (1.1), the lower surface of the pavement module (M) and the first rigid support element (M.2), which is difficult to drain precisely because the body of the spike (1.2) has been inserted under pressure into the recess (M.4) and because the sealing ring of the spike (1.7) fits into the sealing ring groove (M.5), acts as a first cushioning element.

At a later time, immediately after absorption of the impact, possible by the air pocket (3), the force is transmitted to the base of the spike (1.3) which contracts causing the feet of the spike (1.4) to come into contact with the seating base, thus helping to absorb the energy that is generated by the impact under the pavement module (M). This force is not uniform, neither in time nor in location. For this reason, the feet of the spike (1.4) existing at the base of the spike (1.3) gradually and locally absorb, as required, the energy generated by the force exerted on the pavement module (M).

According to Newton's third law, "for every action there is a reaction equal in magnitude and in the opposite direction".

Applying this law to the equipment of the invention, once the force that is exerted is gradually and locally absorbed, the corresponding reaction is also locally and gradually exerted. Because the various components and elements in the invention's equipment allow the force absorbed to be greater than that absorbed by other identical equipment, the corresponding reaction will also be greater, that is, the energy restitution to the user is greater. As the force that is exerted is gradually and locally absorbed, the corresponding energy restitution is also locally and gradually returned.

The shock absorber is made of a resilient material, namely but not limited to an elastomer such as rubber, silicone or a polymer. Many other suitable resilient materials are possible.

The invention claimed is:

1. A modular system for pavement consisting of:

a pavement module comprising a top surface layer, a plurality of a first rigid support elements that integrate in their inner wall a sealing ring groove, a plurality of a second rigid support elements and a plurality of a recesses;

a resilient cushioning system consisting of at least a cushioning spike;

wherein the cushioning spike incorporates:

a body of the spike with a truncated-cone shape, base of the spike, which incorporates at least three feet of the spike, and by the connecting line from the first end of a sealing ring of the spike to the second end of a head of skype being in permanent contact with the inner wall of the first rigid support element, and at least a circumference of the outer side of the wall of a body of the spike being in permanent contact with the inner side of the wall of the first rigid support element.

2. The modular pavement system according to claim 1, wherein the cushioning spike is additionally formed by an orifice of the spike and a cavity of the spike.

3. The modular pavement system according to claim 1, wherein the head of the spike has a truncated-cone shape that in a substantially centred position presents the orifice of the spike extending into the body of the spike forming the cavity of the spike.

4. The modular pavement system according to claim 1, wherein having additionally an air pocket formed by the python recess and the space delimited by the python head, the lower surface of the floor module and the first rigid support element.

5. The modular pavement system according to claim 1, wherein the cushioning spike has the appropriate dimensions so as to fit inside the first rigid support element, i.e., in the recess.

6. The modular pavement system according to claim 1, wherein the cushioning spike is inserted under pressure into the recess.

7. The modular pavement system according to claim 1, wherein the sealing ring of the spike is inserted into the sealing ring groove present in the recess.

8. The modular pavement system according to claim 1, wherein the base of the spike and the feet of the spike remain outside the recess.

9. The modular pavement system according to claim 1, wherein the energy absorption is carried out by the air in the air pocket formed by the cavity of the spike and the space delimited by the head of the spike, the lower surface of the pavement module and the first rigid support element.

10. The modular pavement system according to claim 1, wherein when the flooring module is at rest, i.e. when no force is being applied on the top surface layer, it is the base of the spike that is in contact with the laying base.

11. The modular pavement system according to claim 1, wherein the energy absorption is carried out by the contracting of the base of the spike so that the feet of the spike come into contact with the laying base.

12. The modular pavement system according to claim 1, wherein the feet of the spike at the base of the spike gradually and locally absorb, as required, the force exerted on the pavement module.

* * * * *